US009772589B2

(12) United States Patent
Akamatsu

(10) Patent No.: US 9,772,589 B2
(45) Date of Patent: Sep. 26, 2017

(54) IMAGE FORMING APPARATUS

(71) Applicant: CANON KABUSHIKI KAISHA, Tokyo (JP)

(72) Inventor: Yuki Akamatsu, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 250 days.

(21) Appl. No.: 13/836,969

(22) Filed: Mar. 15, 2013

(65) Prior Publication Data

US 2013/0287413 A1 Oct. 31, 2013

(30) Foreign Application Priority Data

Apr. 27, 2012 (JP) ..... 2012-102581

(51) Int. Cl.

| | |
|---|---|
| ***G03G 15/20*** | (2006.01) |
| ***G03G 15/23*** | (2006.01) |
| ***G03G 15/00*** | (2006.01) |
| ***G03G 21/20*** | (2006.01) |
| ***B65H 29/58*** | (2006.01) |
| ***B65H 29/60*** | (2006.01) |

(52) U.S. Cl.

CPC ..... *G03G 15/2085* (2013.01); *G03G 15/2028* (2013.01); *G03G 15/235* (2013.01); *G03G 15/70* (2013.01); *G03G 21/206* (2013.01); *B65H 29/58* (2013.01); *B65H 29/60* (2013.01)

(58) Field of Classification Search

CPC ..... G03G 2215/00548; G03G 2215/00776; G03G 2215/00552; B65H 29/58; B65H 29/60

See application file for complete search history.

(56) References Cited

U.S. PATENT DOCUMENTS

| | | | | |
|---|---|---|---|---|
| 5,421,463 | A * | 6/1995 | Okazaki et al. | 209/559 |
| 6,116,595 | A * | 9/2000 | d'Agrella et al. | 271/279 |
| 8,355,642 | B2 | 1/2013 | Shoji et al. | |
| 2002/0071684 | A1* | 6/2002 | Hirako | G03G 15/6529 399/18 |
| 2009/0052965 | A1* | 2/2009 | Shoji et al. | 399/401 |
| 2009/0310983 | A1* | 12/2009 | Shoji et al. | 399/20 |
| 2010/0119244 | A1* | 5/2010 | Kitagawa | 399/21 |
| 2011/0064428 | A1* | 3/2011 | Hara | B41J 11/006 399/21 |

FOREIGN PATENT DOCUMENTS

| | | | |
|---|---|---|---|
| EP | 2141548 | A2 | 1/2010 |
| JP | 2001-316018 | A | 11/2001 |
| JP | 2010-026477 | A | 2/2010 |

* cited by examiner

*Primary Examiner* — R. A. Smith
*Assistant Examiner* — John M Royston
(74) *Attorney, Agent, or Firm* — Fitzpatrick, Cella, Harper & Scinto

(57) ABSTRACT

An image forming apparatus suppresses the occurrence of dew condensation in a post-processing operation when the sheet is jammed. When information indicating that a sheet is jammed is received, if the sheet detecting sensor detects the sheet on a switching member, a controller executes a conveying action to drive the sheet conveying portion until an upstream edge of the sheet in the sheet conveyance direction passes through the switching member and then stops the sheet conveying portion.

15 Claims, 8 Drawing Sheets

IMAGE FORMING APPARATUS

BACKGROUND OF THE INVENTION

Field of the Invention

The present invention relates to an image forming apparatus that forms an image on a sheet.

Description of the Related Art

Generally, when an image is transferred on both sides of a sheet, in the image forming apparatus, a transferring portion transfers an image onto a first surface of a sheet, the sheet is conveyed such that the direction of the sheet is converted and then inverted by an inverting mechanism. The sheet is resupplied to the transferring portion so that the image is transferred onto a second surface.

Further, the image forming apparatus has a function that discharges the sheet where an image is transferred onto the first surface to the outside of the apparatus or inversely discharges the sheet so as to align a page and includes a plurality of conveying paths whose discharge ports are arbitrarily converted.

Many of the image forming apparatuses have a configuration where a downstream in a sheet conveyance direction of a discharging portion in a sheet conveyance direction is disposed outside the apparatus and are easily affected by an atmospheric temperature. A sheet to which a toner image is transferred and which is heated and pressurized by a fixing device is conveyed to the discharging portion while having a predetermined heat.

If a conveying guide which forms a conveying path is formed of a metal plate in order to extend a life-span, in some cases, a moisture which is discharged from a sheet which passes through the fixing device is cooled by the conveying guide of the discharging portion to cause dew condensation that water droplets are attached onto the conveying guide. If a sheet is conveyed again onto the conveying guide in which the dew condensation occurs, the water droplets are attached from the conveying guide onto the sheet and thus a conveyance resistance between the sheet and the conveying guide is increased to stop the sheet. Therefore, a sheet jam may occur.

As for this problem, in Japanese Patent Laid-Open No. 2001-316018, in a diverging portion which allows a sheet to be selectively conveyed into conveying paths, a venting hole is provided in a switching member that diverges the conveying path and air is blown from the lower part of the switching member by an air-blowing device. Therefore, humid air around the diverging portion is discharged outside the apparatus without being held therein. Accordingly, the occurrence of the dew condensation is suppressed without cooling the moisture discharged from the sheet by the conveying guide of the discharging portion.

According to the technology disclosed in Japanese Patent Laid-Open No. 2001-316018, the occurrence of the dew condensation which occurs during conveying the sheet can be suppressed. However, it is difficult to suppress the dew condensation which occurs at the time of post-processing the sheet jam after the sheet jam occurs around the diverging portion when an image is formed on a plurality of sheets.

When a sheet jam occurs around the diverging portion at the time of forming an image on a plurality of sheets, in the discharging portion, a sheet which is fixed by the fixing device and has a predetermined heat remains around the diverging portion. Therefore, even though air is blown from the air-blowing device, the discharging of the moisture, which is discharged from the sheet, from the switching member is hindered by the sheet.

Accordingly, the moisture is cooled by the conveying guide of the discharging portion so that the dew condensation occurs in the conveying guide. If the sheet is conveyed again to the discharging portion in this state after the post-processing of the sheet jam, the conveyance resistance between the sheet and the conveying guide is increased so that the sheet jam occurs again. The sheet jam increases a temperature of the conveying guide of the discharging portion and the dew condensation continuously occurs until the conveying guide is at a temperature where the moisture discharged from the sheet is cooled so as not to be dew-condensed.

Meanwhile, when it is intended to increase image quality of the image forming apparatus and cope with the expanding of the kinds of available sheet media, it is difficult to mount the configuration disclosed in Japanese Patent Laid-Open No. 2001-316018 and it is further difficult to suppress the occurrence of the dew condensation.

If a venting hole is provided in the switching member which is disposed near the fixing device, there are a sheet surface having a rapid cooling speed which contacts with a portion of the switching member where the venting hole is not present in a width direction perpendicular to a conveyance direction of the sheet and a sheet surface having a slow cooling speed which faces the venting hole. For example, if a sheet such as a coat paper whose surface is coated is used, an image defect such as a gloss irregularity caused by a difference in cooling speed occurs on the sheet surface of the jammed sheet.

Therefore, it is required to form the conveying guide such as a switching member which contacts with the sheet immediately after the fixing device on a surface which does not have the venting hole. Since it is difficult to provide the venting hole, the humidity air easily remains so that the dew condensation easily occurs.

The present invention is contrived to provide an image forming apparatus that suppresses the occurrence of the dew condensation at the time of post-processing a sheet jam and prevents an additional sheet from being jammed.

SUMMARY OF THE INVENTION

A representative configuration of the image forming apparatus according to the present invention includes a transferring portion which transfers a toner image onto a sheet, a fixing portion which fixes the transferred toner image onto the sheet by heat, a switching member that switches a conveying path of the sheet fixed by the fixing portion, a sheet conveying portion which is provided downstream in a sheet conveyance direction of the switching member to convey the sheet, a sheet detector which detects the sheet guided to the switching member, and a controller which controls an operation of the sheet conveying portion based on a detection signal of the sheet detector. If the sheet detector detects the sheet when information indicating that the sheet jam occurred is received, the controller drives the sheet conveying portion until an upstream edge of the sheet in the sheet conveyance direction passes the switching member.

Further features of the present invention will become apparent from the following description of exemplary embodiments with reference to the attached drawings.

DESCRIPTION OF THE EMBODIMENTS

Preferred embodiments of the image forming apparatus according to the present invention will be described in detail with reference to the drawings.

First Embodiment

First, a configuration in which a sheet 2 is conveyed onto a reversing path 83 illustrated in FIG. 2 and then inversely discharged onto a discharge tray 66 in a state where an image formed surface faces down will be described.

<Configuration of Image Forming Apparatus>

Figure 1:
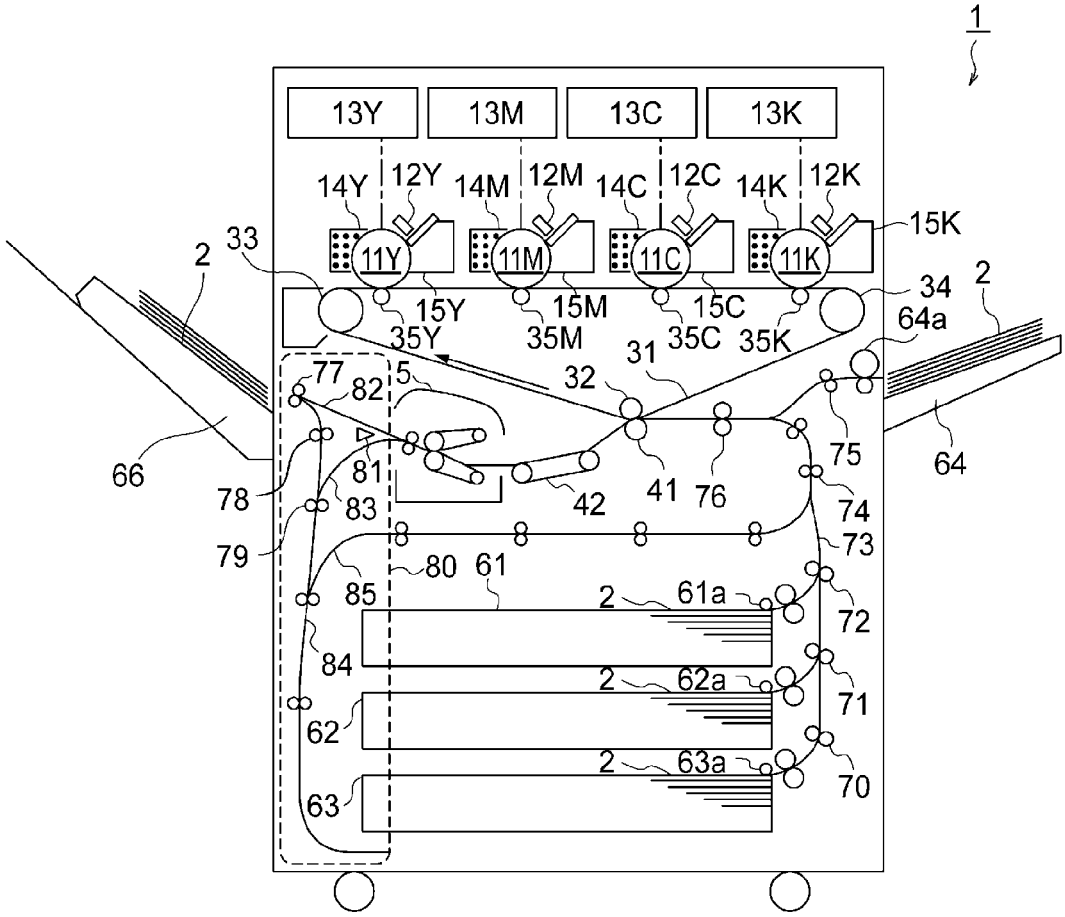
FIG. 1 is a cross-sectional diagram illustrating a configuration of an image forming apparatus according to the present invention.

FIG. 1 illustrates a schematic cross-sectional diagram of an image forming apparatus 1 according to an embodiment. The image forming apparatus 1 according to the embodiment is a color image forming apparatus which uses an electrophotographic system. In recent years, from an advantage in that adaptivity to a large variety of sheets 2 or print productivity is excellent, an intermediate transfer tandem method in which four color image forming portions are arranged so as to be parallel to each other on an outer peripheral surface of an intermediate transfer belt 31 becomes a main stream. The embodiment adopts an intermediate transfer tandem method. The sheet 2 is accommodated in feed cassettes 61 to 63 and a feed tray 64 so as to be laminated therein.

The sheet 2 is fed by feeding rollers 61*a* to 64*a* corresponding to an image forming timing. The sheet 2 which is delivered by the feeding rollers 61*a* to 64*a* is conveyed by conveying rollers 70, 71, 72, and 74 to be conveyed to a registration roller 76 which is a conveying portion before being transferred.

The registration roller 76 abuts an upstream edge of the sheet 2, in the sheet conveyance direction, which is conveyed from the feed cassettes 61 to 63 or the feed tray 64 to create a loop so as to correct skew feeding along the upstream edge of the sheet 2 in the sheet conveyance direction. Further, the registration roller 76 conveys the sheet 2 onto a secondary transferring portion which includes a nip portion of an intermediate transfer belt 31 and a secondary transfer roller 41 at a predetermined timing according to a timing of forming an image on the sheet 2, that is, a toner image which is beared onto a surface of a photosensitive drum 11 which serves as an image bearing member.

The secondary transferring portion is a nip portion which secondarily transfers the toner image on a sheet 2 formed by a secondary transfer counter roller 32 which is opposite to the secondary transfer roller 41 with the intermediate transfer belt 31 interposed therebetween. A predetermined pressure and an electrostatic load bias are applied to the secondary transferring portion to secondarily transfer the toner image on the sheet 2.

With respect to the conveying process of the sheet 2 to the secondary transferring portion as described above, an image forming process where the sheet is sent to the secondary transferring portion at the same timing will be described.

The image forming portion includes photosensitive drums 11Y, 11M, 11C, and 11K, charging devices 12Y, 12M, 12C, and 12K, and exposing devices 13Y, 13M, 13C, and 13K. The image forming portion further includes developing devices 14Y, 14M, 14C, and 14K, primary transferring devices 35Y, 35M, 35C, and 35K, and photosensitive drum cleaners 15Y, 15M, 15C, and 15K. For the convenience of description, a photosensitive drum 11 will be described as a representative of the photosensitive drums 11Y, 11M, 11C, and 11K. Other image forming process portions will be described similarly.

A surface of the photosensitive drum 11 is uniformly charged by the charging device 12 in advance. A surface of the rotating photosensitive drum 11 is exposed by an exposing device 13 based on a signal of image information sent from an external computer 6 illustrated in FIG. 6 to form an electrostatic latent image.

A toner is supplied onto the electrostatic latent image formed on the surface of the photosensitive drum 11 by the developing device 14 so that the image is developed by the toner and is actualized on the surface of the photosensitive drum 11 as a toner image. Thereafter, a predetermined pressure and an electrostatic load bias are applied by the primary transferring device 35 and the toner image is transferred onto an outer peripheral surface of the intermediate transfer belt 31. Thereafter, a little amount of a residual transfer toner which remains on the surface of the photosensitive drum 11 is collected by the photosensitive drum cleaner 15 and then the photosensitive drum 11 is ready for next image forming operation.

The image forming portions described above, as illustrated in FIG. 1, include four color sets, for example, yellow Y, magenta M, cyan C, and black K image forming portions. The number of colors is not limited to four and the arrangement order of the colors is not limited to the order illustrated in FIG. 1.

<Intermediate Transfer Belt>

Continuously, the intermediate transfer belt 31 will be described. The intermediate transfer belt 31 is stretched by a stretching member which includes a driving roller 33, a tension roller 34, and the secondary transfer counter roller 32 and conveyed in a direction indicated by an arrow illustrated in FIG. 1.

Individual color image forming processes which are simultaneously processed by individual color image forming portions which are provided along the outer peripheral surface of the intermediate transfer belt 31 are performed at a predetermined timing. The predetermined timing is a timing when individual color toner images sequentially overlap a toner image having a color which is primarily transferred on the outer peripheral surface of the intermediate transfer belt 31 at the uppermost stream of the intermediate transfer belt 31 in the conveyance direction. As a result, finally a full color toner image is formed on the outer peripheral surface of the intermediate transfer belt 31 and then conveyed to the secondary transferring portion.

In the secondary transferring portion, a full color toner image is secondarily transferred onto the sheet 2. Thereafter, the sheet 2 is conveyed by a suction conveying belt 42 onto the fixing device 5 which serves as a fixing portion which fixes the image on the sheet 2 using heat. The suction conveying belt 42 sucks the sheet 2 using air by a fan which is not illustrated and then conveys the sheet 2. The fixing device 5 melts and fixes the toner image on the sheet 2 by adding a predetermined pressure by opposing rollers or belts and generally, a heating effect by a heat source such as a heater. The sheet 2 which has the fixed image obtained as described above is conveyed to a discharging portion 80.

Here, a conveying path is selected to convey the sheet 2 to any one of a discharge conveying path 82 that discharges the sheet 2 whose image formed surface faces up onto the discharge tray 66 and a reversing path 83 that reversely discharges the sheet 2 whose image formed surface faces down.

Figure 2:
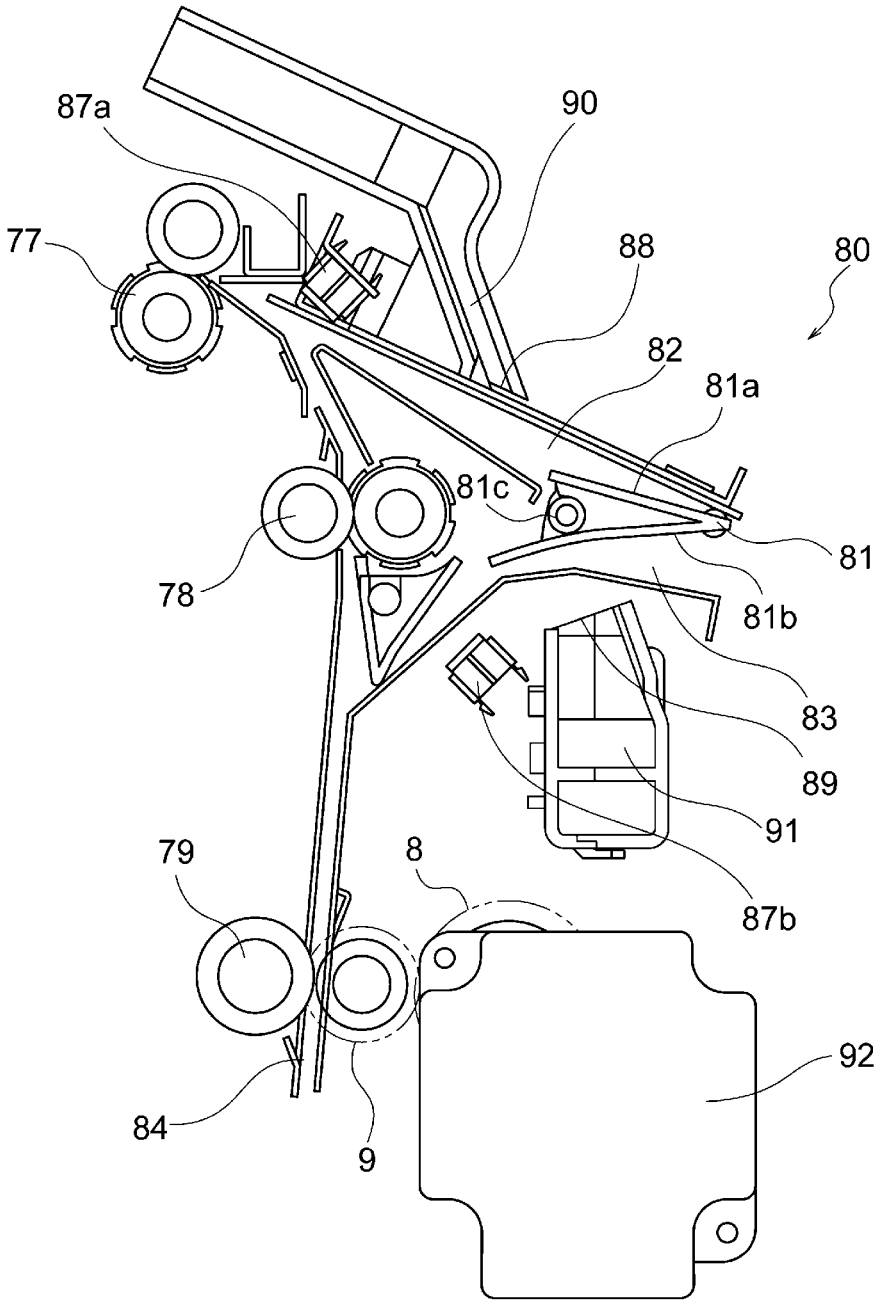
FIG. 2 is a cross-sectional diagram illustrating a configuration of a discharging portion.

In the embodiment, it is described that the switching member 81 is rotated at the upper side of FIG. 2 to guide the sheet 2 into the reversing path 83 to reversely discharge the sheet 2. The switching member 81 which rotates around a rotational shaft 81*c* illustrated in FIG. 2 is switched to the upper side of FIG. 2 by an action of a solenoid which is not illustrated. Accordingly, the sheet 2 slides on a bottom surface 81*b* of the switching member 81 so as to be in contact with the bottom surface 81*b* and guided to be led from the reversing path 83 to a switch back path 84.

The switching member 81 is disposed further downstream in the sheet conveyance direction than the fixing device 5 and serves as a conveying guide that guides the sheet 2 onto which the toner image is fixed by the fixing device 5 to be conveyed.

A switch back operation is performed to forward reverse the rotational direction of a reversing roller 79 which is disposed further downstream in the sheet conveyance direction than the fixing device 5, the switching member 81, and an air-blowing port 88 and serves as a sheet conveying portion which conveys the sheet 2 so that a leading edge and a trailing edge of the sheet 2 are switched and the sheet 2 is conveyed to a discharge roller 77. This reversing operation allows the sheet 2 whose image formed surface faces down to be discharged to the discharge tray 66 illustrated in FIG. 1.

Thereafter, the sheet 2 re-joins a sheet 2 for a subsequent job which is conveyed by each of feeding rollers 61*a* to 64*a* at a precise timing and then is sent to the secondary transferring portion via the registration roller 76 as described above. Since an image forming process of a rear surface (second surface) is same as the image forming process of the front surface (first surface) described above, the description thereof will be omitted.

When the sheet 2 is reversely discharged, the switching member 81 is switched to the upper side of FIG. 2 so that the sheet 2 is led from the reversing path 83 to the switch back path 84. The reversing rollers 78 and 79 are reversed so that the sheet 2 is ejected to the direction opposite to the conveyance direction and discharged onto the discharge tray 66 while setting the downstream edge of the conveyed sheet 2 in the sheet conveyance direction to a leading position.

<Configuration of Discharging Portion>

Figure 3:
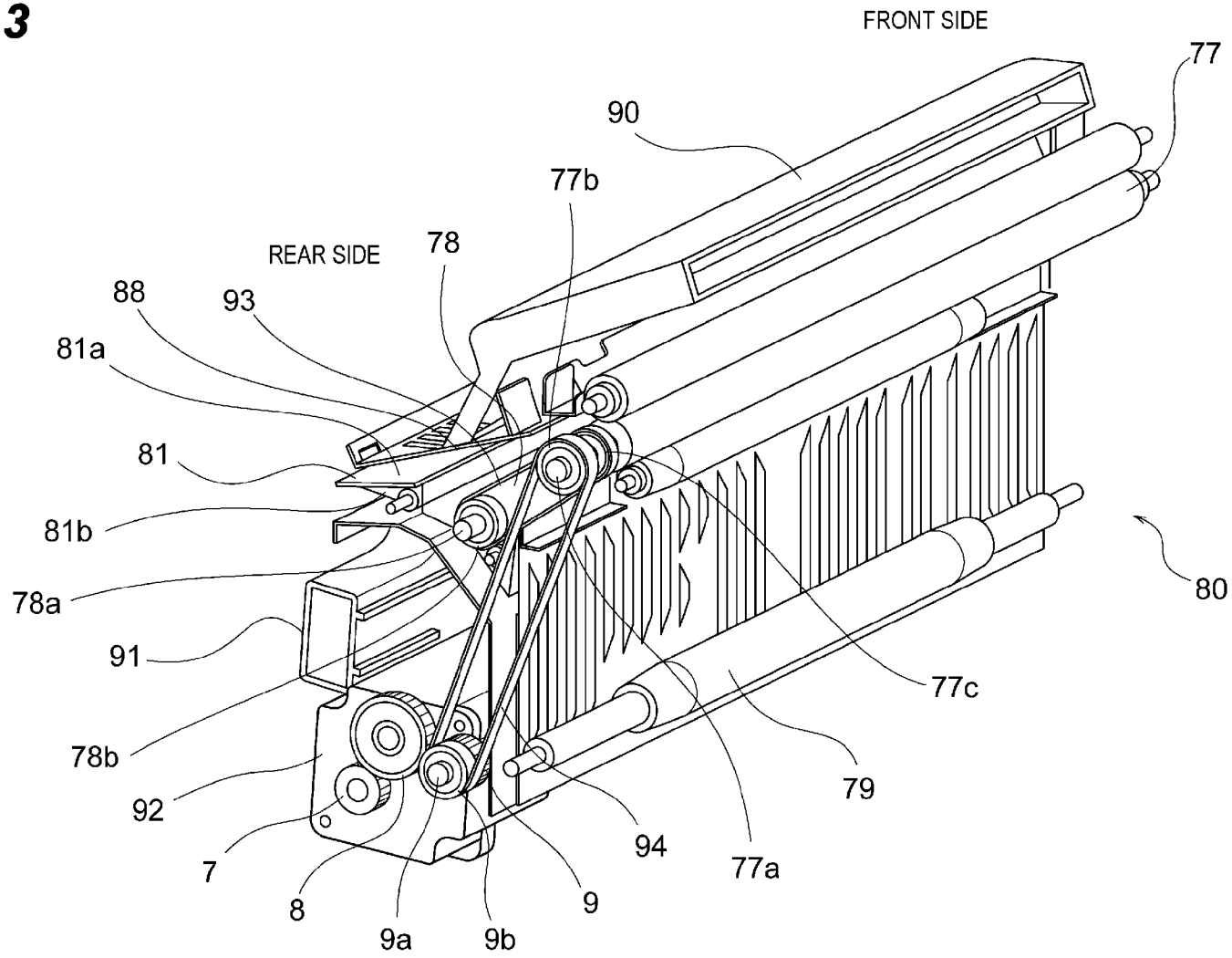
FIG. 3 is a perspective diagram of the discharging portion illustrated in FIG. 2 as seen from a left oblique direction.
Figure 4:
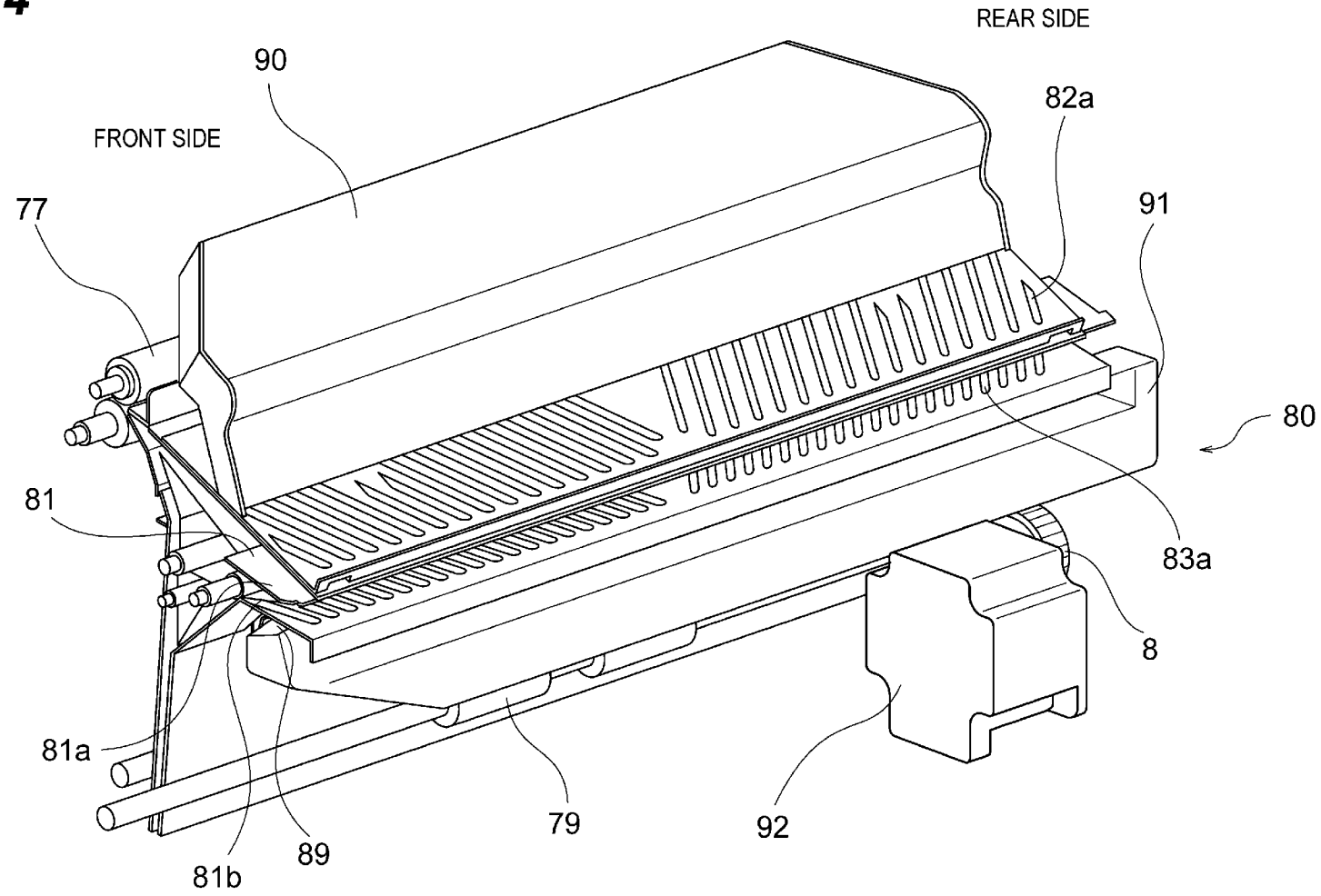
FIG. 4 is a perspective diagram of the discharging portion illustrated in FIG. 2 as seen from a right oblique direction.

FIG. 2 is a cross-section diagram illustrating a configuration of the discharging portion 80 according to the embodiment. FIGS. 3 and 4 are perspective diagrams illustrating a configuration of the discharging portion 80 according to the embodiment. Sheet detecting sensors 87*a* and 87*b* which serve as sheet detectors that detect the sheets 2 on the conveying guide of each of the discharge conveying path 82 and the reversing path 83 are provided.

Further, an air-blowing device 90 which serves as an air-blowing portion having the air-blowing port 88 that blows air from the upper side of FIG. 2 onto the sheet 2 on the discharge conveying path 82 (in the sheet conveying path) is provided. The air-blowing port 88 is disposed on the discharge conveying path 82. The air-blowing port 88 is provided downstream of the switching member 81, in the sheet conveyance direction, which also serves as the conveying guide and blows air to the sheet 2 to be conveyed. A discharge roller 77 which serves as a sheet conveying portion to discharge the sheet 2 is disposed further downstream in the sheet conveyance direction than the fixing device 5. The discharge conveying path 82 is a sheet conveying path between the fixing device 5 and the discharge roller 77.

Further, an air-blowing device 91 which serves as an air-blowing portion having an air-blowing port 89 that blows air from the lower side of FIG. 2 onto the sheet 2 on the reversing path 83 (in the sheet conveying path) is provided. The air-blowing port 89 is disposed on the reversing path 83. A reversing roller 79 which serves as a sheet conveying portion to convey the sheet 2 is disposed further downstream in the sheet conveyance direction than the fixing device 5. The reversing path 83 is a sheet conveying path between the fixing device 5 and the reversing roller 79.

As illustrated in FIG. 3, a gear 7 is fixed to a drive shaft of a motor 92 which serves as a drive source and a gear 8 is engaged with the gear 7 and a gear 9 is engaged with the gear 8 to form a gear train. A pulley 9*b* is fixed to a rotational shaft 9*a* of the gear 9. A pulley 77*b* is fixed to a rotational shaft 77*a* of the discharge roller 77. A timing belt 94 is stretched between the pulley 9*b* and the pulley 77*b*.

Another pulley 77*c* is fixed to the rotational shaft 77*a* of the discharge roller 77. A pulley 78*b* is fixed to a rotational shaft 78*a* of the reversing roller 78. A timing belt 93 is stretched between the pulley 77*c* and the pulley 78*b*.

By doing this, a rotational driving force of the motor 92 is transmitted to each of the rollers 77 to 79 through the gears 7 to 9 and the timing belts 94 and 93. The sheet 2 which is guided to the discharge conveying path 82, the reversing path 83, and the switch back path 84 is conveyed to a desired direction by the forward reverse of each of the rollers 77 to 79 while being nipped by the rollers.

Figure 6:
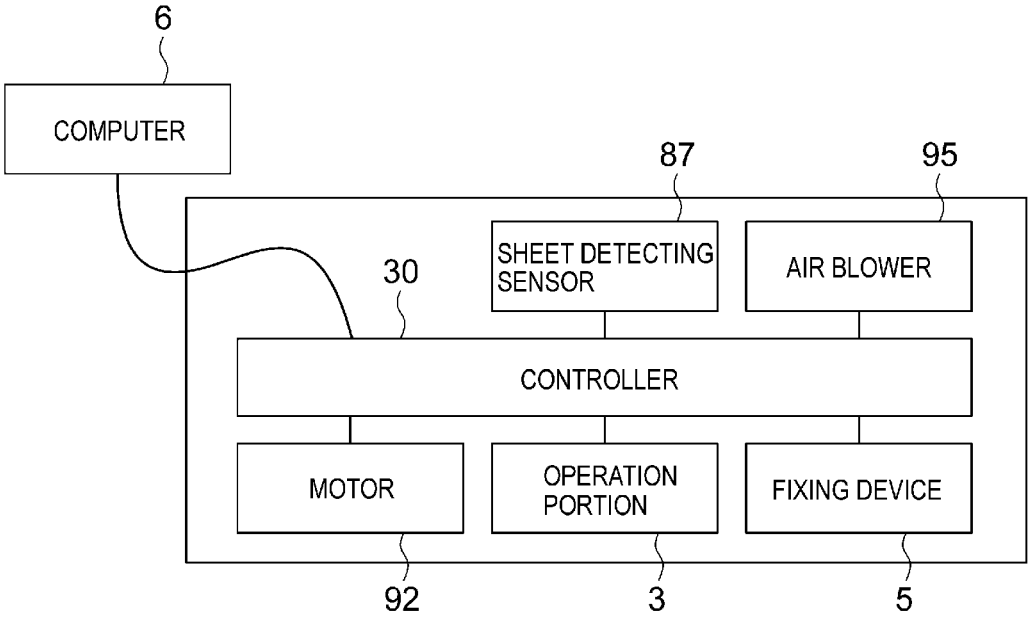
FIG. 6 is a block diagram illustrating a configuration of a control system of an image forming apparatus according to the present invention.

The air-blowing devices 90 and 91 discharge air (aerial flow) which is sent by an air blower 95 illustrated in FIG. 6 which is disposed in the main body of the image forming apparatus 1 in the entire width direction of the sheet 2 (a direction perpendicular to the sheet conveyance direction) from the air-blowing ports 88 and 89. Penetrating venting holes 82*a* and 83*a* illustrated in FIG. 4 are provided in the conveying guide on the sheet conveying path of each of the discharge conveying path 82 and the reversing path 83. Therefore, the air discharged from the air-blowing ports 88 and 89 of the air-blowing devices 90 and 91 passes through the venting holes 82*a* and 83*a* to be blown on both sides of the sheet 2.

Figure 5A:
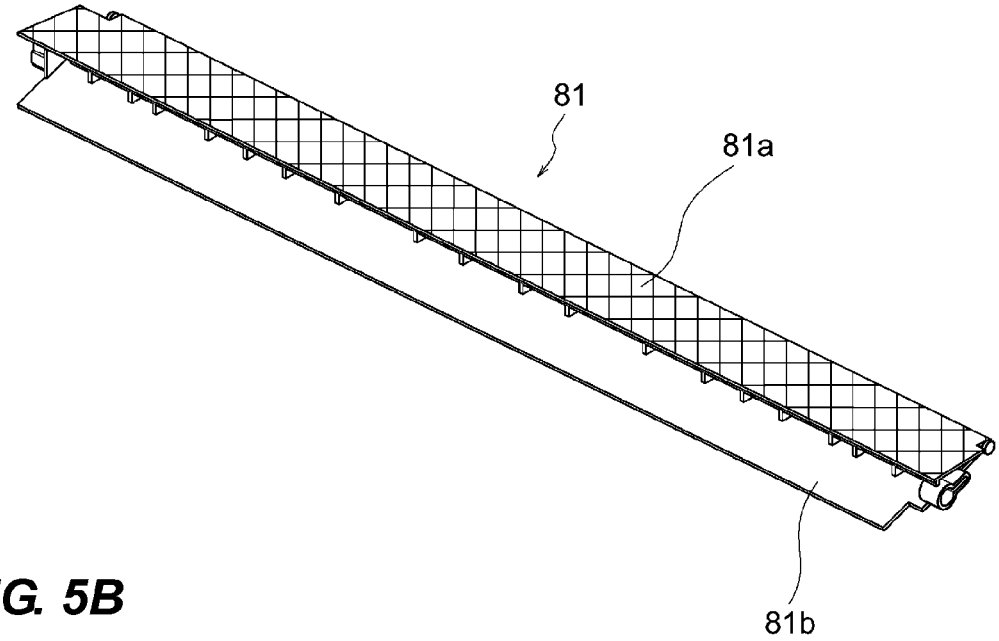
FIG. 5A is a perspective diagram of a conveying guide which also serves as a switching member which diverges the conveying path as seen from the upper side.
Figure 5B:
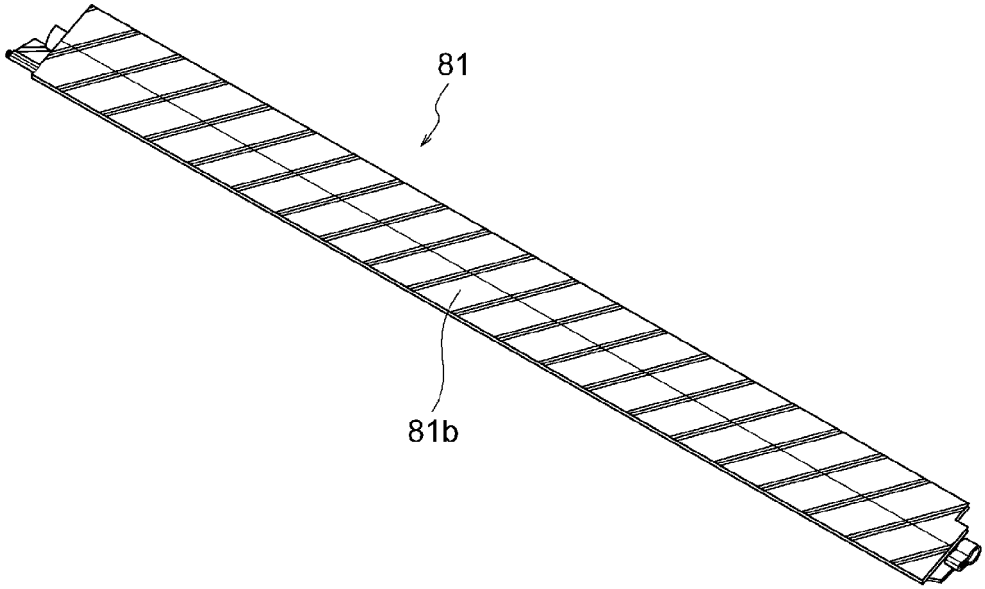
FIG. 5B is a perspective diagram of a conveying guide which also serves as a switching member which diverges the conveying path as seen from the lower side.

FIGS. 5A and 5B are perspective diagrams of the switching member 81 which is provided on the sheet conveying path immediately after the fixing device 5 in the discharging portion 80 to serve as a conveying guide. The switching member 81 is a conveying guide immediately after the fixing device 5. Further, the switching member 81 is a conveying guide which actively contacts with the sheet 2 even when any one of the discharge conveying path 82 and the reversing path 83 is selected as the conveyance direction of the sheet 2. Therefore, a top surface 81*a* as seen from the upper side of the image forming apparatus 1 and a bottom surface 81*b* as seen from the lower side of the image forming apparatus 1 are formed to have a guide surface portion whose longitudinal direction extends as a width direction perpendicular to the sheet conveyance direction.

<Post-Processing Operation when Sheet is Jammed>

Continuously, a post-processing operation when a sheet is jammed in a case when the sheet 2 is conveyed in the reversing path 83 illustrated in FIGS. 1 and 2 will be described. FIG. 6 illustrates a configuration of a control system of the image forming apparatus 1 and FIG. 7 is a flowchart explaining a post-processing operation when a sheet is jammed.

During the image formation, detection information of the sheet 2 by the sheet detecting sensor 87 which is disposed at every part of the sheet conveying path of the main body of the image forming apparatus 1 is collected and sent to a controller 30 which serves as a controller to determine whether the sheet is jammed. An operation portion 3 is illustrated in FIG. 6.

In some cases, even though a predetermined time has elapsed, the sheet detecting sensor 87 cannot detect that the sheet 2 reaches. Or even though a predetermined time has elapsed, the sheet detecting sensor 87 continuously detects the sheet 2 so that the sheet 2 does not escape from the position. In these cases, the controller 30 determines that the sheet is jammed in a position of the target sheet detecting sensor 87.

Figure 7:
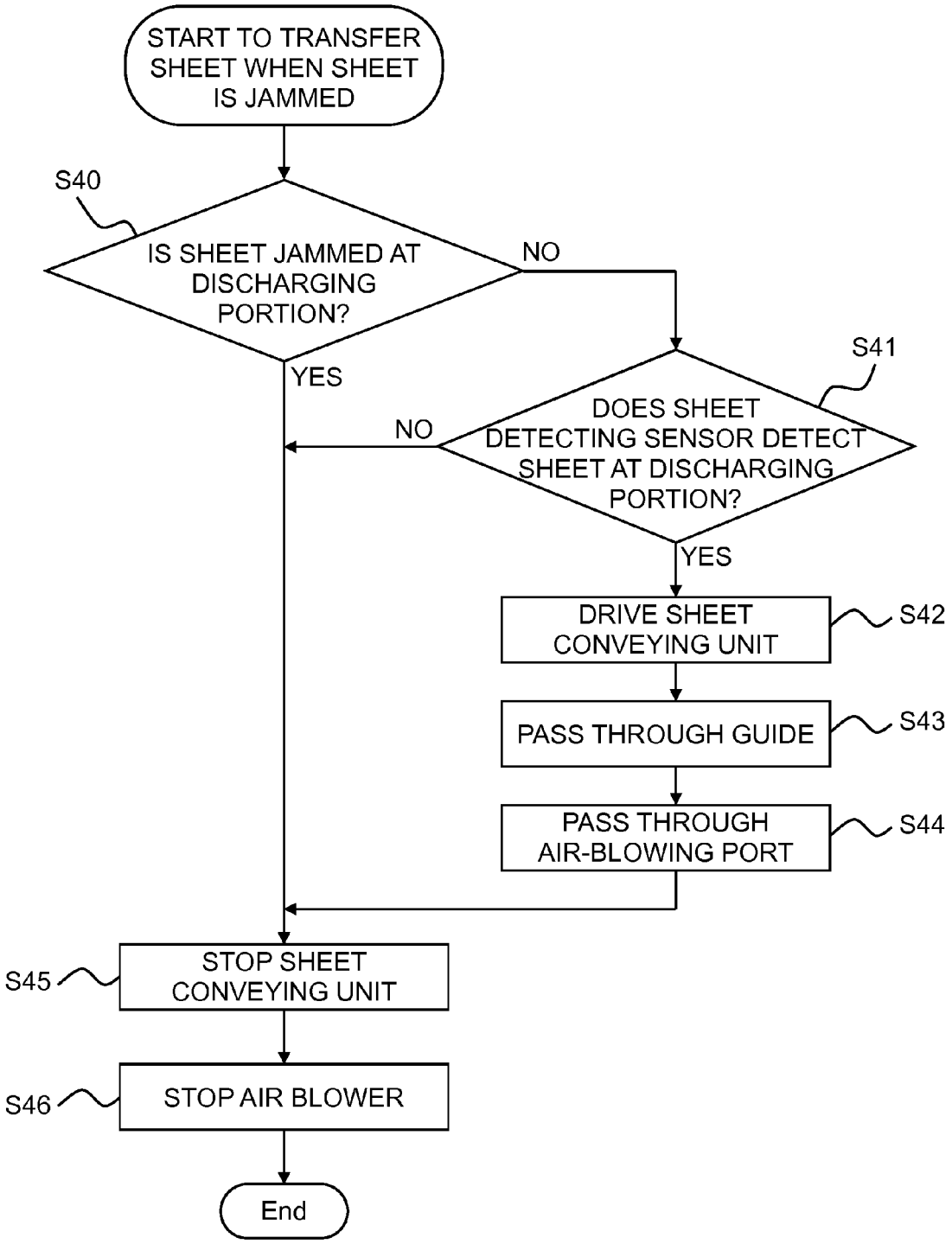
FIG. 7 is a flowchart explaining a post-processing operation of the image forming apparatus according to the present invention when a sheet is jammed.

When the sheet is jammed, in step S40 of FIG. 7, the controller 30 determines whether the sheet detecting sensor 87 which detects the sheet jam is the sheet detecting sensor 87*b* of the discharging portion 80 illustrated in FIG. 2. If the sheet jam is detected by the sheet detecting sensor 87*b* of the discharging portion 80, the sequence proceeds to step S45 of FIG. 7 to stop the rotation of the motor 92 to stop the rollers 77 and 79 and stop the conveyance of the sheet 2. This is because if the sheet is jammed in the discharging portion 80, parts may be broken or the sheet jam may be hard to be processed.

Then, the sequence proceeds to step S46 to stop air-blowing by the air blower 95 and discharging of the aerial flow by the air-blowing devices 90 and 91.

Continuously, a post-processing operation when the sheet detecting sensor 87 which detects the sheet jam is not the sheet detecting sensor 87*b* of the discharging portion 80 will be described.

In step S40 of FIG. 7, when the sheet detecting sensor 87 which detects the sheet jam is not the sheet detecting sensor 87*b* of the discharging portion 80, the sequence proceeds to step S41 to determine whether the sheet detecting sensor 87*b* of the discharging portion 80 detects the sheet 2. If the sheet detecting sensor 87*b* of the discharging portion 80 does not detect the sheet 2, the sequence proceeds to step S45 to stop the rotation of the motor 92 to stop the rollers 77 and 79 and stop the conveyance of the sheet 2. Then, the sequence proceeds to step S46 to stop air-blowing by the air blower 95 and discharging of the aerial flow by the air-blowing devices 90 and 91.

Continuously, a post-processing operation when the sheet detecting sensor 87*b* of the discharging portion 80 detects the sheet 2 in step S41 of FIG. 7 will be described.

In step S41 of FIG. 7, if the sheet detecting sensor 87*b* of the discharging portion 80 detects the sheet 2, the sequence proceeds to step S42 and the sheet 2 is continuously conveyed as it is by the rollers 77 and 79. The sheet 2 passes through a guide surface portion whose longitudinal direction extends as a width direction perpendicular to the sheet conveyance direction, among the conveying guides in the reversing path 83 (step S43).

Thereafter, the sheet 2 passes through the air-blowing port 89 of the air-blowing device 91 (step S44). Thereafter, the sequence proceeds to step S45 of FIG. 7 to stop the rotation of the motor 92 to stop the rollers 77 and 79 and stop the conveyance of the sheet 2. Then, the sequence proceeds to step S46 to stop air-blowing by the air blower 95 and discharging of the aerial flow by the air-blowing devices 90 and 91.

In other words, in the post-processing operation when the sheet is jammed, the sheet detecting sensor 87*b* of the discharging portion 80 detects the sheet 2.

Then, the controller 30 drives the rollers 77 and 79 which serve as the sheet conveying portion until the downstream edge of the sheet 2 in the sheet conveyance direction passes through a bottom surface 81*b* of the switching member 81 which is provided in the reversing path 83 to serve as a conveying guide. The bottom surface 81*b* of the switching member 81 is a surface portion whose longitudinal direction is disposed in a direction perpendicular to the sheet conveyance direction. After the downstream edge of the sheet 2 in the sheet conveyance direction passes through a bottom surface 81*b* which serves as the surface portion, the controller 30 stops the rollers 77 and 79.

Further, in the post-processing operation when the sheet is jammed, the sheet detecting sensor 87*b* of the discharging portion 80 detects the sheet 2. The controller 30 drives the rollers 77 and 79 which serve as the sheet conveying portion until the downstream edge of the sheet 2 in the sheet conveyance direction passes through the air-blowing port 89 of the air-blowing device 91. After the downstream edge of the sheet 2 in the sheet conveyance direction passes through the air-blowing port 89, the controller 30 stops the rollers 77 and 79.

In this case, a conveyance distance of the sheet 2 is calculated by the controller 30 based on a detecting signal of the sheet detecting sensor 87*b* which is closest to the upstream edge of the sheet 2 in the sheet conveyance direction, among the sheet detecting sensor 87 through which the sheet 2 remaining in the discharging portion 80 passes.

The controller 30 calculates the position of the upstream edge of the sheet 2 in the sheet conveyance direction from a time after the upstream edge of the sheet 2 in the sheet conveyance direction passes through the sheet detecting sensor 87*b* and a conveying speed of the sheet 2 which is set in advance by the rotational speed of the rollers 77 and 79 driven by the motor 92. Thereafter, the position of the downstream edge of the sheet 2 in the sheet conveyance direction is calculated by a predetermined length of the sheet 2 in the conveyance direction. By doing this, the position of the downstream edge of the sheet 2 in the sheet conveyance direction to the bottom surface 81*b* of the switching member 81 or to the air-blowing port 89 of the air-blowing device 91 is calculated to determine the conveyance distance of the sheet 2.

Figure 8:
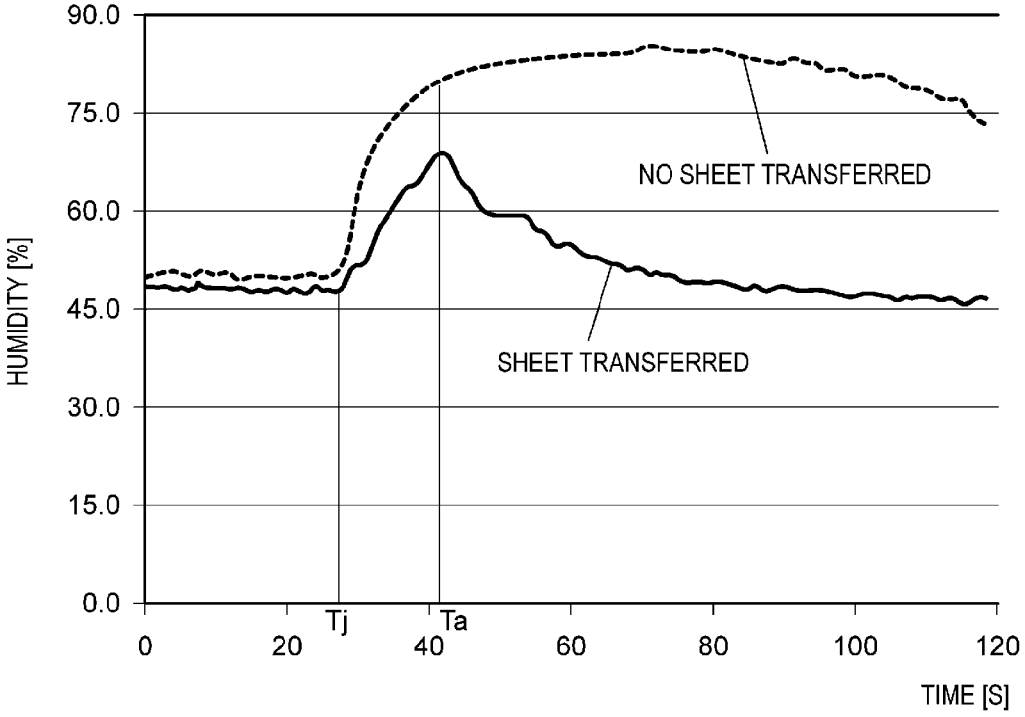
FIG. 8 is a view illustrating a relationship between an elapsed time and a humidity in the discharging portion in a case when the post-processing is performed to convey the sheet and a case when the sheet remains without being conveyed when the sheet is jammed in the image forming apparatus according to the present invention.

FIG. 8 illustrates a relationship between an elapsed time and a humidity in the discharging portion 80 in a case when the post-processing operation is performed to convey the sheet 2 and a case when the sheet 2 remains without being conveyed when the sheet is jammed in the image forming apparatus 1 according to the embodiment.

A solid line illustrated in FIG. 8 represents a relationship of the elapsed time after the sheet 2 is conveyed by performing the post-processing operation when the sheet is jammed and a humidity around the discharging portion 80 in the embodiment. A broken line illustrated in FIG. 8 represents a relationship of the elapsed time when the sheet remains without being conveyed when the sheet is jammed and the humidity around the discharging portion 80. A time $T_j$ represented at the horizontal axis of FIG. 8 is a time when the sheet is jammed and a time $T_a$ is a time when the post-processing operation is performed when the sheet is jammed to convey the sheet 2 and the downstream edge of the sheet 2 in the sheet conveyance direction passes through the air-blowing port 89 of the air-blowing device 91 according to the embodiment.

As illustrated by the broken line of FIG. 8, if the sheet 2 remains without being conveyed when the sheet is jammed, the humidity around the discharging portion 80 is continuously increased from the time $T_j$ when the sheet is jammed.

In contrast, as illustrated by the solid line of FIG. 8, if the post-processing operation is performed when the sheet is jammed to convey the sheet 2 according to the embodiment, the humidity around the discharging portion 80 is increased from the time $T_j$ when the sheet is jammed. However, the sheet 2 is conveyed until the sheet 2 passes through the air-blowing port 89 of the air-blowing device 91 so that the time when the humidity around the discharging portion 80 is increased is stopped at a time $\{T_a-T_j\}$.

The post-processing operation when the sheet is jammed according to the embodiment is performed to stop the sheet 2 in a state where the sheet 2 is conveyed until the sheet 2 passes through the air-blowing port 89 of the air-blowing device 91. Accordingly, the moisture discharged from the sheet 2 which passes through the fixing device 5 does not remain in the sheet conveying path of the discharging portion 80. Further, the aerial flow discharged from the air-blowing port 89 of the air-blowing device 91 is not interrupted by the sheet 2. Therefore, the occurrence of the dew condensation may be suppressed. Accordingly, after performing the post-processing operation when the sheet is jammed, the repeated sheet jam caused by the dew condensation may be eliminated.

Further, the controller 30 drives the rollers 77 and 79 until the downstream edge of the sheet 2 in the sheet conveyance direction passes through a bottom surface 81*b* of the switching member 81 provided in the reversing path 83. After the downstream edge of the sheet 2 in the sheet conveyance direction passes through the bottom surface 81*b*, the controller 30 stops the rollers 77 and 79.

Also in this case, the moisture discharged from the sheet 2 which passes through the fixing device 5 is cooled by the metal switching member 81 to prevent the dew condensation from occurring on the bottom surface 81*b* of the switching member 81. Accordingly, after the post-processing operation when the sheet is jammed, the repeated sheet jam caused by the dew condensation may be eliminated.

Second Embodiment

Next, a configuration in which a sheet 2 is conveyed onto the discharge conveying path 82 illustrated in FIG. 2 and then discharged onto the discharge tray 66 in a state where an image formed surface faces up will be described. The same configurations as the first embodiment are denoted by the same reference numerals and the description thoseof will be omitted.

In the embodiment, it is described that the switching member 81 is rotated at the lower side of FIG. 2 to guide the sheet 2 into the discharge conveying path 82 to discharge the sheet 2. The switching member 81 which oscillates around a rotational shaft 81*c* illustrated in FIG. 2 is switched to the lower side of FIG. 2 by an action of a solenoid which is not illustrated. Therefore, the sheet 2 is guided while being slid to be in contact with the top surface 81*a* of the switching member 81 and conveyed in the discharge conveying path 82.

The sheet 2 is conveyed onto a discharge roller 77 which is disposed further downstream in the sheet conveyance direction than the fixing device 5 and serves as a sheet conveying portion conveying the sheet 2. The sheet 2 whose image formed surface faces up is discharged to the discharge tray 66 illustrated in FIG. 1.

<Post-Processing Operation when Sheet is Jammed>

Continuously, a post-processing operation when a sheet is jammed in a case when the sheet 2 is conveyed in the discharge conveying path 82 illustrated in FIGS. 1 and 2 will be described.

Similarly to the first embodiment, when the sheet is jammed, in step S40 of FIG. 7, the controller 30 determines whether the sheet detecting sensor 87 which detects the sheet jam is the sheet detecting sensor 87*a* of the discharging portion 80 illustrated in FIG. 2. If the sheet jam is detected by the sheet detecting sensor 87*a* of the discharging portion 80, the sequence proceeds to step S45 of FIG. 7 to stop the rotation of the motor 92 to stop the roller 77 and stop the conveyance of the sheet 2. This is because if the sheet is jammed in the discharging portion 80, parts may be broken or the sheet jam may be hard to be processed.

Then, the sequence proceeds to step S46 to stop air-blowing by the air blower 95 and discharging of the aerial flow by the air-blowing devices 90 and 91.

Continuously, a post-processing operation when the sheet detecting sensor 87 which detects the sheet jam is not the sheet detecting sensor 87*a* of the discharging portion 80 will be described.

In step S40 of FIG. 7, when the sheet detecting sensor 87 which detects the sheet jam is not the sheet detecting sensor 87*a* of the discharging portion 80, the sequence proceeds to step S41 to determine whether the sheet detecting sensor 87*a* of the discharging portion 80 detects the sheet 2. If the sheet detecting sensor 87*a* of the discharging portion 80 does not detect the sheet 2, the sequence proceeds to step S45 to stop the rotation of the motor 92 to stop the roller 77 and stop the conveyance of the sheet 2. Then, the sequence proceeds to step S46 to stop air-blowing by the air blower 95 and discharging of the aerial flow by the air-blowing devices 90 and 91.

Continuously, a post-processing operation when the sheet detecting sensor 87*a* of the discharging portion 80 detects the sheet 2 in step S41 of FIG. 7 will be described.

In step S41 of FIG. 7, if the sheet detecting sensor 87*a* of the discharging portion 80 detects the sheet 2, the sequence proceeds to step S42 and the sheet 2 is continuously conveyed as it is by the roller 77. The sheet 2 passes through a guide surface portion whose longitudinal direction extends as a width direction perpendicular to the sheet conveyance direction, among the conveying guides in the discharge conveying path 82 (step S43).

Thereafter, the sheet 2 passes through the air-blowing port 88 of the air-blowing device 90 (step S44). Thereafter, the sequence proceeds to step S45 of FIG. 7 to stop the rotation of the motor 92 to stop the roller 77 and stop the conveyance of the sheet 2. Then, the sequence proceeds to step S46 to stop air-blowing by the air blower 95 and discharging of the aerial flow by the air-blowing devices 90 and 91.

In other words, in the post-processing operation when the sheet is jammed, the sheet detecting sensor 87*a* of the discharging portion 80 detects the sheet 2.

Then, the controller 30 drives the roller 77 which serves as the sheet conveying portion until the downstream edge of the sheet 2 in the sheet conveyance direction passes through a top surface 81*a* of the switching member 81 which is provided in the discharge conveying path 82 to serve as the conveying guide. The top surface 81*a* of the switching member 81 is a surface portion whose longitudinal direction is disposed in a direction perpendicular to the sheet conveyance direction. After the downstream edge of the sheet 2 in the sheet conveyance direction passes through the top surface 81*a* which serves as the surface portion, the controller 30 stops the roller 77.

Further, in the post-processing operation when the sheet is jammed, the sheet detecting sensor 87*a* of the discharging portion 80 detects the sheet 2. The controller 30 drives the roller 77 which serves as the sheet conveying portion until the downstream edge of the sheet 2 in the sheet conveyance direction passes through the air-blowing port 88 of the air-blowing device 90. After the downstream edge of the sheet 2 in the sheet conveyance direction passes through the air-blowing port 88, the controller 30 stops the roller 77.

In this case, a conveyance distance of the sheet 2 is calculated by the controller 30 based on a detecting signal of the sheet detecting sensor 87*a* which is closest to the upstream edge of the sheet 2 in the sheet conveyance direction, among the detecting sensors 87 through which the sheet 2 remaining in the discharging portion 80 passes.

The controller 30 calculates the position of the upstream edge of the sheet 2 in the sheet conveyance direction from a time after the upstream edge of the sheet 2 in the sheet conveyance direction passes through the sheet detecting sensor 87*a* and a conveying speed of the sheet 2 which is set in advance by the rotational speed of the roller 77 driven by the motor 92. Thereafter, the position of the downstream edge of the sheet 2 in the sheet conveyance direction is calculated by a preset length of the sheet 2 in the conveyance direction. By doing this, the position of the downstream edge the sheet 2 in the sheet conveyance direction of to the top surface 81*a* of the switching member 81 or to the air-blowing port 88 of the air-blowing device 90 is calculated to determine the conveyance distance of the sheet 2.

FIG. 8 illustrates a relationship between an elapsed time and a humidity in the discharging portion 80 in a case when the post-processing operation is performed to convey the sheet 2 and a case when the sheet 2 remains without being conveyed when the sheet is jammed in the image forming apparatus 1 according to the embodiment.

A solid line illustrated in FIG. 8 represents a relationship of the elapsed time after the sheet is conveyed by performing the post-processing operation when the sheet is jammed and a humidity around the discharging portion 80 in the embodiment. A broken line illustrated in FIG. 8 represents a relationship of the elapsed time when the sheet 2 remains without being conveyed when the sheet is jammed and the humidity around the discharging portion 80. A time $T_j$ represented at the horizontal axis of FIG. 8 is a time when the sheet is jammed and a time $T_a$ is a time when the post-processing operation when the sheet is jammed according to the embodiment is performed to convey the sheet 2 and the downstream edge of the sheet 2 in the sheet conveyance direction passes through the air-blowing port 88 of the air-blowing device 90.

As illustrated by the broken line of FIG. 8, if the sheet 2 remains without being conveyed when the sheet is jammed, the humidity around the discharging portion 80 is continuously increased from the time $T_j$ when the sheet is jammed.

In contrast, as illustrated by the solid line of FIG. 8, if the post-processing operation when the sheet is jammed according to the embodiment is performed to convey the sheet 2, the humidity around the discharging portion 80 is increased from the time $T_j$ when the sheet is jammed. However, the sheet 2 is conveyed until the sheet 2 passes through the air-blowing port 88 of the air-blowing device 90 so that the time when the humidity around the discharging portion 80 is increased is stopped at a time $\{T_a-T_j\}$.

The post-processing operation when the sheet is jammed according to the embodiment is performed to stop the sheet 2 in a state where the sheet 2 is conveyed until the sheet 2 passes through the air-blowing port 88 of the air-blowing device 90. Accordingly, the moisture discharged from the sheet 2 which passes through the fixing device 5 does not remain in the sheet conveying path of the discharging portion 80. Further, the aerial flow discharged from the air-blowing ports 88 and 89 of the air-blowing devices 90 and 91 is not interrupted by the sheet 2. Therefore, the occurrence of the dew condensation may be suppressed. Accordingly, after performing the post-processing operation when the sheet is jammed, the repeated sheet jam caused by the dew condensation may be eliminated.

Further, the controller 30 drives the roller 77 until the downstream edge of the sheet 2 in the sheet conveyance direction passes through the top surface 81*a* of the switching member 81 provided in the discharge conveying path 82. After the downstream edge of the sheet 2 in the sheet conveyance direction passes through the top surface 81*a*, the controller 30 stops the roller 77.

Also in this case, the moisture discharged from the sheet 2 which passes through the fixing device 5 is cooled by the metal switching member 81 to prevent the dew condensation from occurring on the top surface 81*a* of the switching member 81. Accordingly, after performing the post-processing operation when the sheet is jammed, the repeated sheet jam caused by the dew condensation may be eliminated. The other configuration is the same as that of the first embodiment and the same effect may be achieved.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-102581, filed Apr. 27, 2012, which is hereby incorporated by reference herein in its entirety.

What is claimed is:

1. An image forming apparatus, comprising:

a transferring portion which transfers a toner image onto a sheet;

a fixing portion which fixes the transferred toner image onto the sheet by heat;

a switching member which switches a conveying path of the sheet fixed by the fixing portion;

a sheet conveying portion which is provided downstream in a sheet conveyance direction of the switching member to convey the sheet;

a first sheet detector which detects the sheet guided by the switching member;

a second sheet detector configured to detect the sheet conveyed; and a controller configured to control an operation of the sheet conveying portion so that each of the following scenarios is met:

(a) in a case that the controller determines a sheet jam occurs based on a signal from the second sheet detector and the first sheet detector detects the sheet at a time when the controller determines the sheet jam occurs, the controller configuration is such that the controller executes a conveying action to drive the sheet conveying portion until an upstream edge of the sheet in the sheet conveyance direction passes through the switching member and then stops the sheet conveying portion, (b) in a case that the controller determines a sheet jam occurs based on a signal from the second sheet detector and the first sheet detector does not detect the sheet at a time when the controller determines the sheet jam occurs, the controller configuration is such that the controller stops the sheet conveying portion without operating the conveying action according to a signal to show that the first sheet detector does not detect the sheet in a case that occurrence of jam is determined, and (c) in a case that the controller determines that a sheet jam occurs according to a signal from only the first sheet detector, the controller configuration is such that the controller stops the conveying portion without operating the conveying action.

2. The image forming apparatus according to claim 1, wherein the controller stops the sheet conveying portion after the upstream edge of the sheet in the sheet conveyance direction passes through the switching member.

3. The image forming apparatus according to claim 1, wherein the sheet conveying portion is a discharge roller that discharges the sheet to the outside of the apparatus.

4. The image forming apparatus according to claim 1, wherein the sheet conveying portion is a reversing roller that reversely conveys the sheet to a discharging portion which discharges the sheet to the outside of the apparatus.

5. An image forming apparatus, comprising:

a transferring portion that transfers a toner image onto a sheet;

a fixing portion which fixes the transferred toner image onto the sheet by heat;

a conveying guide that guides the sheet fixed by the fixing portion;

an air-blowing port which is provided downstream in the sheet conveyance direction of the conveying guide and blows air to the conveyed sheet;

a sheet conveying portion which is provided downstream in a sheet conveyance direction of the air-blowing port to convey the sheet;

a first sheet detector which detects the sheet on the conveying guide;

a second sheet detector configured to detect the sheet conveyed; and a controller configured to control an operation of the sheet conveying portion so that each of the following scenarios is met:

(a) in a case that the controller determines a sheet jam occurs based on a signal from the second sheet detector and the first sheet detector detects the sheet at a time when the controller determines the sheet jam occurs, the controller configuration is such that the controller executes a conveying action to drive the sheet conveying portion until an upstream edge of the sheet in the sheet conveyance direction passes through the air-blowing port and then stops the sheet conveying portion, (b) in a case that the controller determines a sheet jam occurs based on a signal from the second sheet detector and the first sheet detector does not detect the sheet at a time when the controller determines the sheet jam occurs, the controller configuration is such that the controller stops the sheet conveying portion without operating the conveying action according to a signal to show that the first sheet detector does not detect the sheet in a case that occurrence of jam is determined, and (c) in a case that the controller determines that a sheet jam occurs according to a signal from only the first sheet detector, the controller configuration is such that the controller stops the conveying portion without operating the conveying action.

6. The image forming apparatus according to claim 5, wherein the controller stops the sheet conveying portion after the upstream edge of the sheet in the sheet conveyance direction passes through the air-blowing port.

7. The image forming apparatus according to claim 5, wherein the conveying guide is a switching member which switches the conveying path of the sheet.

8. The image forming apparatus according to claim 5, wherein the sheet conveying portion is a discharge roller that discharges the sheet to the outside of the apparatus.

9. The image forming apparatus according to claim 5, wherein the sheet conveying portion is a reversing roller that reversely conveys the sheet to a discharging portion which discharges the sheet to the outside of the apparatus.

10. The image forming apparatus according to claim 1, wherein the first sheet detector detects the sheet beside the switching member.

11. The image forming apparatus according to claim 1, wherein the controller controls the sheet conveying portion so as to stop the sheet at the sheet conveying path according to the detection signal from the first sheet detector, when the controller excuses the conveying action.

12. The image forming apparatus according to claim 5, wherein the first sheet detector detects the sheet beside the air-blowing port.

13. The image forming apparatus according to claim 5, wherein the controller controls the sheet conveying portion so as to stop the sheet at the sheet conveying path according to the detection signal from the first sheet detector, when the controller excuses the conveying action.

14. The image forming apparatus according to claim 1, wherein the controller determines that the sheet jam occurs based on a fact the first sheet detector detects the sheet in a certain period.

15. The image forming apparatus according to claim 5, wherein the controller determines that the sheet jam occurs based on a fact the first sheet detector detects the sheet in a certain period.

* * * * *